US005431351A

United States Patent [19]

Lejonklou

[11] Patent Number: 5,431,351

[45] Date of Patent: Jul. 11, 1995

[54] WEAR ELEMENT FOR A ROTATING MILL-DRUM

[76] Inventor: Harald K. Lejonklou, P.O. Box 4397, Pythagoras Street 7, Limasol, Cyprus

[21] Appl. No.: 129,107

[22] PCT Filed: Feb. 12, 1993

[86] PCT No.: PCT/SE93/00111

§ 371 Date: Nov. 2, 1993

§ 102(e) Date: Nov. 2, 1993

[87] PCT Pub. No.: WO93/15839

PCT Pub. Date: Aug. 19, 1993

[30] Foreign Application Priority Data

Feb. 14, 1992 [SE] Sweden ..... 9200439

[51] Int. Cl.[6] ..... B02C 17/22

[52] U.S. Cl. ..... 241/183; 241/299; 241/DIG. 30

[58] Field of Search ..... 241/102, 181, 182, 183, 241/299, DIG. 30

[56] References Cited

U.S. PATENT DOCUMENTS

| | | | |
|---|---|---|---|
| 864,357 | 8/1907 | Brown . | |
| 939,637 | 11/1909 | Rotherham . | |
| 1,055,395 | 3/1913 | Globe . | |
| 1,130,644 | 3/1915 | Steinbach | 241/183 |
| 3,318,537 | 5/1967 | Wallin et al. | 241/183 |
| 4,177,955 | 12/1979 | Miller | 241/183 |
| 4,289,279 | 9/1981 | Brandt | 241/102 |
| 4,848,681 | 7/1989 | Eriksson et al. | 241/183 |
| 5,055,336 | 10/1991 | Davis | 428/137 |

FOREIGN PATENT DOCUMENTS

| | | | |
|---|---|---|---|
| 9189/66 | 2/1968 | Australia . | |
| 60204/73 | 3/1975 | Australia . | |
| 37817/89 | 1/1990 | Australia . | |
| 308058 | 1/1969 | Sweden . | |
| 1304872 | 4/1987 | U.S.S.R. | 241/183 |

*Primary Examiner*—John Husar
*Attorney, Agent, or Firm*—Pennie & Edmonds

[57] ABSTRACT

The invention relates to a lifter bar intended to be mounted internally in a rotating mill drum for grinding ore and minerals. According to the invention, the upper portion of the lifter bar has a carcass of metal, comprising an elongated forward wall element facing in the direction of movement of the wear element, an elongated rear wall element and between these two wall elements transverse wall elements, the wall elements of the carcass defining between them a plurality of spaces, which are at least partially filled with a filler of another material than any of the components of the mill charge, and of greater abrasive specific volume loss than the metal of the carcass.

14 Claims, 2 Drawing Sheets

WEAR ELEMENT FOR A ROTATING MILL-DRUM

Figure 1:
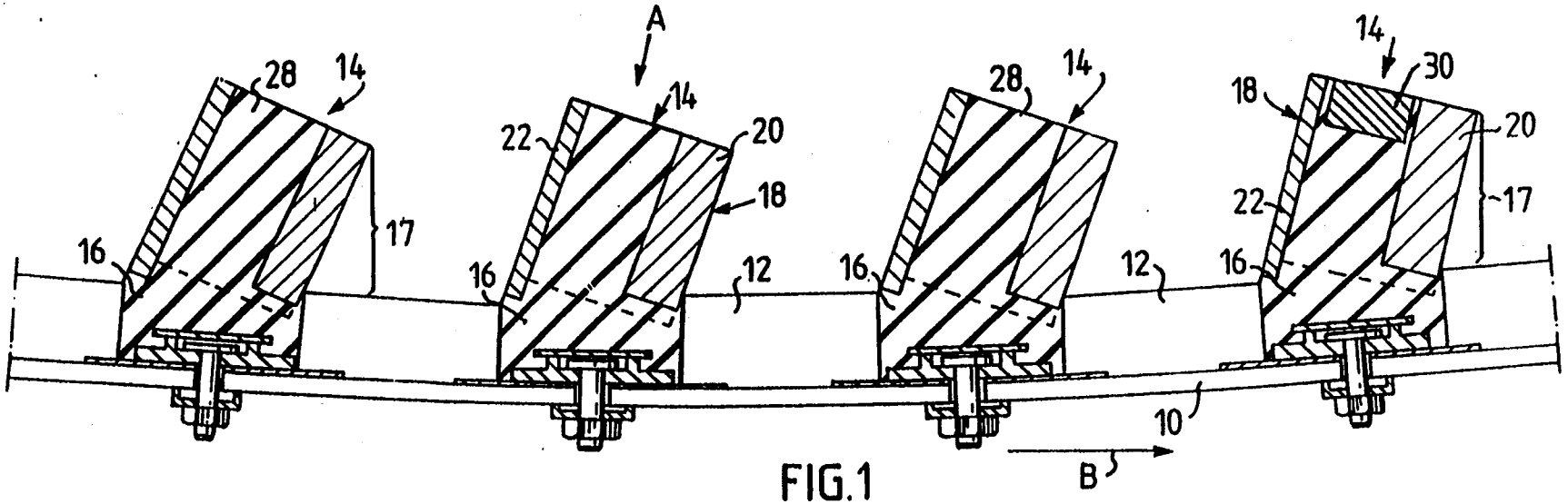

The present invention relates to a wear element in the form of a so-called lifter bar to be mounted on the inside of a rotating drum, in particular a mill for grinding ore and minerals, in order to protect, as a portion of the lining, the drum against wear during its rotation, said wear element consisting of a foot portion, for fixing the wear element in the drum, and an upper portion joined to the foot portion and arranged to extend into the drum.

A mill for grinding ore and minerals is always provided on the inside of the drum with a lining to protect the drum against wear during the milling work which is carried out by pebbles, the ore itselves or milling bodies of metal, such as balls, rods and cylpebs. Such a lining can be made in many ways, but often consists of plates and lifter bars of a wear-resistent material, for example steel or rubber. The lifter bars extend normally in the longitudinal direction of the mill and essentially radially on the heads of the drum and are most often fixed in the drum between the wear plates which are thus clamped in place. A lining consisting of lifter bars and plates has the advantage over smoother designs, that the lifter bars lift the mill charge which thus exerts less slippage and abrasion against the drum walls during the rotation of the drum. By virtue of the fact that the lifter bars are Substantially higher than the plates, these are protected by the lifter bars, which are subjected, primarily from above, to most of the wear. This means that if the wear on the top of the lifter bars can be reduced, the wear on the plates will also be reduced automatically. Lifter bars of wear-resistent rubber are often reinforced or capped with a steel top or steel profile on the side facing the direction of rotation to extend the life of the lifter bar and the lining as a whole.

The purpose of the present invention is to suggest a new type of lifter bar design, which makes it possible in mills such as pebble mills and ball mills, to extend the life of the lifter bars and thus possibly extend the intervals between liner replacements.

In order to solve this task, the wear element of the type described by way of introduction, is broadly characterized in that the upper portion has a carcass of metal, preferably of wear-resistent steel or white cast iron, comprising an elongated forward wall element facing in the direction of rotation of the wear element, an elongated rear wall element and between these wall elements transverse wall elements, the wall elements of the carcass defining between them a plurality of spaces which are at least partially filled with a filler of another material than one of the components of the mill charge, and of greater abrasive specific volume loss than the metal of the carcass.

The cell-like structure of the metal carcass is used primarily to achieve a partly continuous self-protecting effect of the lifter bar. The filler in the spaces of the metal carcass is selected so that it is worn by volume more rapidly than the metal carcass. Cavities are thus gradually dug out at the tops of the lifter bars limited in size by the wall elements of the metal carcass. Components from the mill charge which are wedged between the wall elements in the dug-out cavities or lie loosely therein protect, during the milling process, the upper edges of the metal carcass of the lifter bar which are most subjected to wear by periodically extending thereabove. This increases the life of the lifter bar. Continuity in the self-protecting process is assured by the fact that the depths of the dug-out holes are limited by the relatively short distances between the wall elements.

Since it is advantageous to retain the original height of the lifter bar as long as possible, one can use the metal carcass of the lifter bar and the filler lying in its spaces to support and hold one or more wear bodies of harder material than the metal carcass, the filler next to the wear body essentially serving as a binding agent. In this case, it is assumed that the carcass is made in the hardest possible material in view of the application, at the same time as one should keep in mind that a wear body can be made harder and is stressed more uniformly the smaller it is. Such a body can also be embedded in an elastomeric filler in the spaces of the carcass, which has a dampening effect on the wear body, thus reducing its tendency to crack. The wear body is also surrounded by the wall elements of the metal carcass, which greatly reduces the risk of the end edges of the wear body being chipped-off by the impact of the mill charge. Such wear bodies can consist of a metal harder than that of the metal carcass or of a special material, such as carbides, nitrides or ceramics. The extreme hardnesses of the last mentioned material group has up to now not been utilized either technically or economically for mill linings in the mining industry.

The above-mentioned self-protecting effect and protecting effect with the aid of extra wear bodies can be combined in the same lifter bar.

U.S. Pat. Nos. 939,637, 864,357 and 1,055,395 describe mill linings which can provide a certain amount of self-protecting effect but which relate to designs with initially open oblong channels between ribs for capturing protective grinding pebbles. These known designs have, however, never functioned well in practice, primarily due to the fact that the open channels immediately capture stones which stuck in the bottom of the channels, thus making impossible a continuous repetition of the self-protecting effect.

In the present invention, it is the top surface of the lifter bar (the rib) which is to capture the components from the mill charge, not the open spaces which are formed between the lifter bars (ribs). Furthermore, no initial completely open spaces on the top of the lifter bar are used, rather a metal carcass with wall elements limiting spaces filled with a filler of another material than any of the components of the mill charge, and which is worn down more rapidly than the surrounding metal wall elements, thus successively creating dug-out cavities, which assures repetition of the self-protecting effect, since components from the mill charge fixed to the top of the lifter bar and projecting therefrom can be gradually replaced by new charge material.

Additional characteristics of the wear element according to the invention are disclosed in the subsequent dependent claims.

Figure 3E:
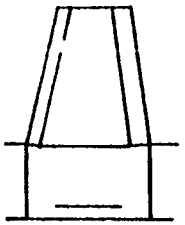
Figure 3D:
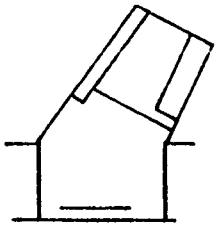
Figure 3C:
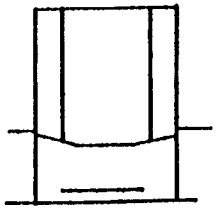
Figure 3B:
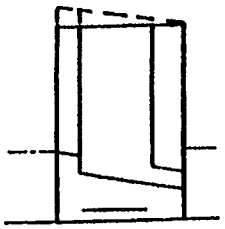
Figure 3A:
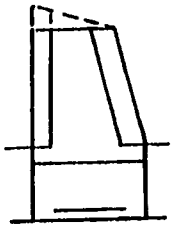
Figure 2:
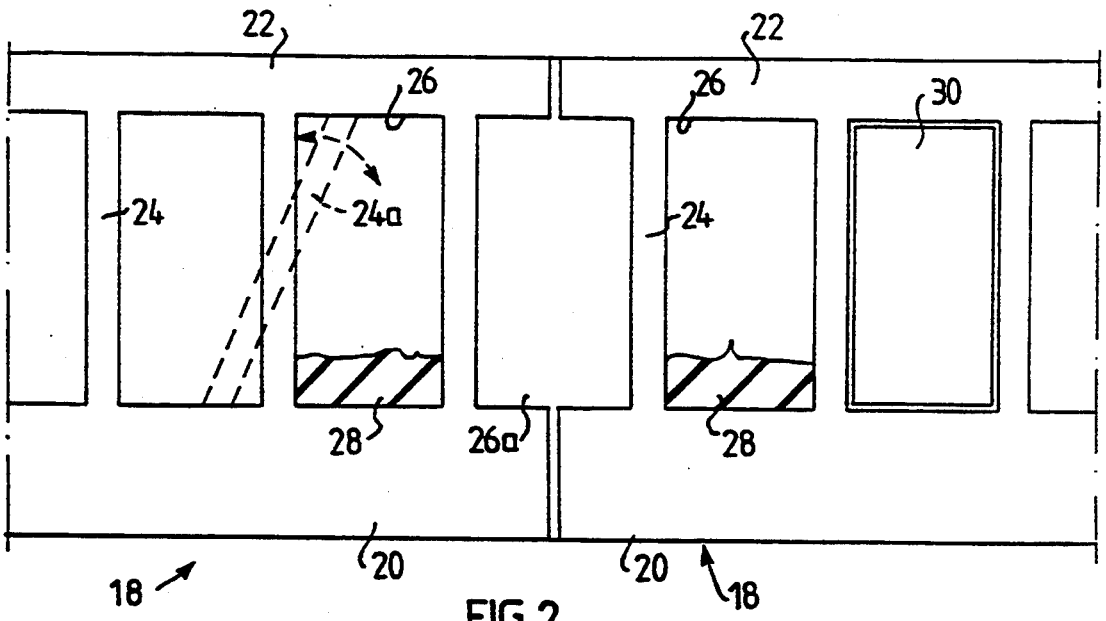
Figure 4:
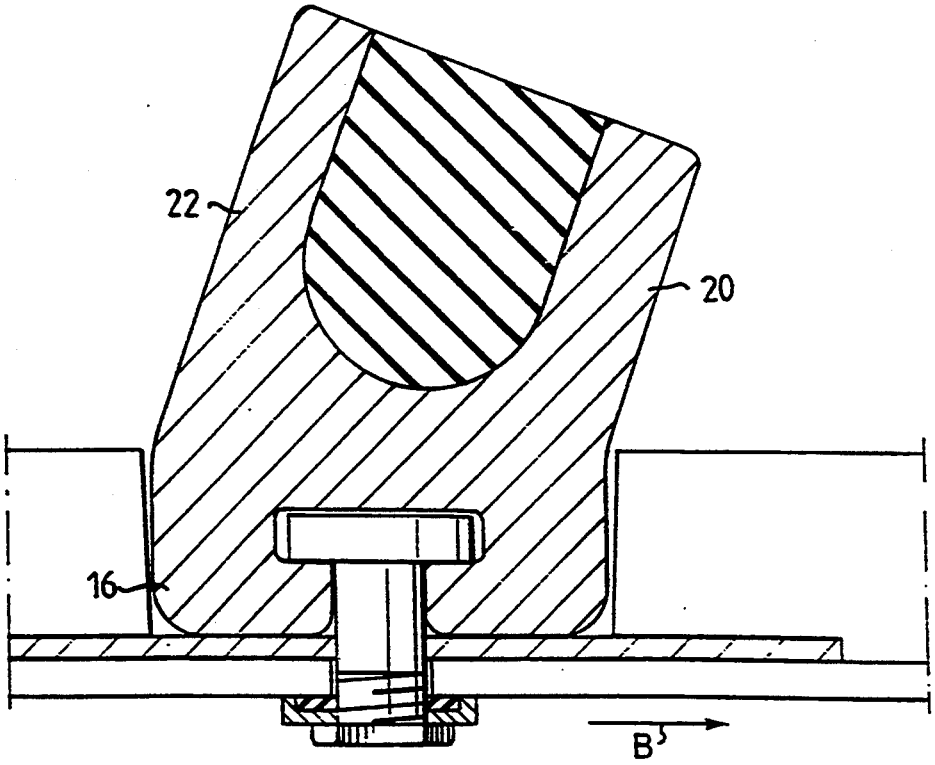

The invention will now be described in more detail below with reference to non-limiting embodiments shown in the accompanying drawings, in which:

FIG. 1 shows a section of a portion of a mill lining in a cylindrical mill with lifter bars which have an elastomeric foot and a filler according to the invention, FIG. 2 shows a longitudinal view from above, perpendicular to the top surface of a lifter bar as indicated by the arrow A in FIG. 1, the metal carcass being divided into two adjacent sections in the upper portion of the lifter bar, FIGS. 3*a*–3*e* show cross-sections of lifter bars according to FIG. 1 but in different configurations of the upper portion of the lifter bar, and FIG. 4 shows an alternative embodiment of a lifter bar according to the invention, wherein the foot portion, which is designed to cooperate with rubber plates with steel lips, and the metal carcass of the upper portion is made in one piece of metal.

FIG. 1 shows a section of a portion of a mill liner in a cylindrical mill drum for grinding ore and minerals. The drum has a shell 10 with a lining consisting of wear plates 12 of an elastomeric material, for example rubber, and lifter bars 14, located between the plates 12 and extending in the longitudinal direction of the drum. Each lifter bar 14 consists of a foot portion 16 by which the lifter bar is anchored to the shell 10 of the drum by means of suitable fixing means, whereby the plates 12 are clamped in place, and an upper portion 17 which extends into the interior of the drum. The upper portion 17 of each lifter bar 14 has a carcass 18 of metal, preferably of wear-resistent steel or white cast iron. The carcass 18 comprises a forward elongated wall element 20 facing the rotational direction B of the drum, a rear elongated wall element 22 and transverse wall elements 24. These wall elements delimit between themselves open spaces 26 (see FIG. 2) designed to be at least partially filled with an elastomeric filler 28 of greater abrasive specific volume loss than the metal in the carcass 18.

In this in detail described embodiment of the invention, the foot portion 16 and the filler 28 in the spaces 26 are formed in one piece of elastomeric material, the metal carcass 18 being joined to the foot portion 16 and the filler 28 by e.g. vulcanization. The filler 28 can suitably extend up to a surface which essentially levels with the upper edges of the walls 20, 22, 24, i.e. so that they fill out the entire or almost the entire spaces 26. Since the inner walls of the metal carcass have a very large total area, the elastomeric filler in this entirely open elastomeric version does not need to extend, for the sake of adhesion, up to the level of the upper edges of the carcass, but can terminate at a lower level with another filler material in the upper end of the spaces. From a practical point of view, it is, however, better to have a filler consisting of only one filler material. In addition to connecting the foot portion 16 and the metal carcass 18, the filler in the spaces is intended to be gradually worn to capture components from the mill charge and thus assure continuity in the self-protecting effect. It is not required that the filler have high wear resistance. Rather, it is advantageous as regards capture and life, if the filling has a markedly poorer resistance to wear than the metal in the carcass. The captured components from the mill charge thus periodically extend up above the upper edges of the walls of the carcass and thus form a protection therefore, so that the metal carcass 18 is worn less rapidly. When the projecting captured components have been worn down to essentially the level of the upper end edges of the wall elements of the carcass 18, they have a greater tendency to crack and break and loosen from the cavities, so that they can be replaced by new larger protective bodies from the mill charge, thus repeating the self-protecting function, possibly after an additional digging-out of the filling in the cavities.

In an alternative embodiment of the invention, a wear body 30 of harder material than that in the metal carcass can be used, as is shown in the right hand lifter bar in FIG. 1 and in the right hand portion of the metal carcass in FIG. 2. The wear body 30, which can be several times harder than the metal in the metal carcass or the components in the mill charge, is embedded in the filler of the cavity leaving a binding layer of filler between the wear body and the walls of the carcass. The wear body 30 normally only takes up a portion of the depth of the space, as can be seen to the right in FIG. 1. In this way, when the wear body 30 has been worn down completely, components from the mill charge can serve as an extra protector for the metal carcass, as described previously. One or several of the transverse walls can be completely or partially eliminated below the hard wear body 30 in order to be able to capture components from the mill charge which are larger than the wear body.

Within the scope of the invention, the metal carcass 18 and its wall elements 20, 22, 24 can be made and oriented in various manners. In the Figures, all of the opposite surfaces of the wall elements are essentially plane parallel. This is, however, not always preferable. The wall elements of the metal carcass can have upper edge surfaces which lie at different levels. According to FIG. 2, the transverse wall elements 24 extend essentially perpendicular to the front and back walls 20, 22. However, the term "transverse" used here and in the patent claims is to be understood as not only referring to such perpendicular wall elements, but also obliquely extending elements, such as are indicated by the dashed lines at **24*a*** in FIG. 2 and also wall elements which are inclined in other manners, are rounded-off or sloped. The spacing between the transverse wall elements can also vary.

A row of lifter bars which extends from end wall to end wall in the mill drum, normally consists of a plurality of lifter bars 14 which are placed end to end. FIG. 2 shows an elastic lifter bar 14 with a longitudinally divided metal carcass 18 which has been made so that a hole **26*a* is formed between the surfaces of two adjacent parts of the carcass, said hole being approximately as big as the rest of the holes 26 in the metal carcass 18. The hole 26*a*** is thus formed in the joint between lifter bars in the same row.

Depending on the method of manufacture, the wall elements in the metal carcass can consist of different alloys, and the wall elements can also form a metal carcass via at least one of the wall elements not being securely joined to the other wall elements.

When the foot portion of the lifter bar and the filling is made in one piece of elastomeric material, the metal carcass can be fixed to the elastomeric piece in other ways than by vulcanization, for example mechanically or chemically. According to a suitable embodiment, which is shown in FIG. 1, the forward and back walls 20, 22 are inclined forwards in the direction of rotation. This provides inter alia an advantageous angle of attack for the components of the mill charge against the top side of the lifter bar filling for a rapid digging out and less wear of the lining as a whole during the milling process. The inclination of each of these walls can be the same or differing, as shown in FIG. 1 and FIGS. 3*a*–*e*.

FIGS. 3*a*–*e* show additional variants of the construction of the metal carcass when the lifter foot and a substantial portion of the filler is elastomeric, these being made in one piece.

FIG. 3*a* shows with solid lines a variant where the forward wall element is inclined backwards and the back wall stands approximately radially in the drum. The dashed lines show that the upper surface of the rear wall is at a higher level than the front edge, so that a forwardly inclined or raised top side is formed similar to that in FIG. 1.

FIG. 3*b* shows variants where both the longitudinal wall elements stand straight up, with or without an inclined top surface.

FIG. 3*c* shows a "symmetrical" metal carcass of a lifter bar which can be used when the drum is driven in either rotational direction, if the drum rotation can be reversed. This can be used to, in general, extend the life of the lining and to get a certain portion of the almost worn-out captured protective bodies from the mill charge to loosen from the wall element of the carcass, and this can additionally extend the life of the lifter bar.

FIG. 4 shows an embodiment of the lifter according to the invention where the upper portion and the foot portion are formed in one piece of metal. The spaces in the upper portion preferably have closed bottoms and are filled with a suitable filler with the purpose of being gradually dug-out and/or serving as a binder material for extra wear bodies as discussed above. A lifter bar with a foot portion of metal can essentially have metal carcasses according to the embodiments in FIGS. 1–3.

I claim:

1. Wear element in the form of a lifter bar (14) to be mounted on the inside of a rotating drum for a mill for grinding ore and minerals in order to protect, as a portion of a mill lining, the drum against wear during its rotation, said wear element consisting of a foot portion (16) for fixing the wear element in the drum and an upper portion (17) joined to the foot portion (16) and arranged to extend into the drum, characterized in that the upper portion (17) has a carcass of wear-resistant metal, comprising an elongated forward wall element (20) facing the direction of rotation of the wear element, an elongated rear wall element (22) and between these wall elements, transverse wall elements (24), the wall elements of the carcass defining between them a plurality of spaces (26), which are at least partially filled with a filler (28) of another material than any of the components of the mill charge, and of greater abrasive specific volume loss than the metal of the carcass (18).

2. Wear element according to claim 1, characterized in that at least one of the two longitudinal wall elements (20, 22) is inclined to a plane perpendicular to the direction of rotation of the wear element (14).

3. Wear element according to claim 1, characterized in that the forward and rear wall elements (20, 22) are essentially parallel to each other.

4. Wear element according to claim 1, characterized in that the upper edge portion of the rear wall element (22) is higher than the upper edge portion of the forward wall element (2) in relation to a horizontal plane through the wear element parallel to the direction of rotation.

5. Wear element according to claim 1, characterized in that the transverse wall elements (24*a*) extend inclined to the longitudinal wall elements (20, 22).

6. Wear element according to claim 1, characterized in that at least one of the transverse walls (24) has a height differing from the height of the other transverse walls.

7. Wear element according to any one of claims 1–6, characterized in that the foot portion (16) consists of metal.

8. Wear element according to claim 1, characterized in that the foot portion (16) and at least a substantial portion of the filler (28) in the spaces (26) is formed in one piece of elastomeric material.

9. Wear element according to claim 8, characterized in that the metal carcass (18) is vulcanized to the elastomeric material.

10. Wear element according to claim 8, characterized in that the metal carcass (18) is divided into a plurality of adjacent sections.

11. Wear element according to claim 1 or 8, characterized in that the filler (28) extends up to a surface lying essentially in level with the upper edges of the wall elements (20, 22, 24).

12. Wear element according to claim 1 or 8, characterized in that bodies (30) of harder wear material than that of the metal carcass (18) are laid into the spaces (26) in the metal carcass and with top surfaces lying essentially in level with the upper edges of the wall elements (20, 22, 24).

13. Wear element in the form of a lifter bar (14) to be mounted spaced apart from other lifter bars, on the inside of a rotating drum, for a mill for grinding ore and minerals in order to protect, as a portion of a mill lining, the drum against wear during its rotation, said wear element consisting of a foot portion (16) for fixing the wear element in the drum and an upper portion (17) joined to the foot portion (16) and arranged to extend into the drum, characterized in that the upper portion (17) has a carcass of wear-resistant metal, comprising an elongated forward wall element (20) facing the direction of rotation of the wear element, an elongated rear wall element (22) and between these wall elements, transverse wall elements (24), the wall elements of the carcass defining between them a plurality of spaces (26) which are at least partially filled with a filler (28) of another material than any of the components of the mill charge, and of greater abrasive specific volume loss than the metal of the carcass (18).

14. A plurality of wear elements in the form of a lifter bar (14), and a rotating drum, for a mill for grinding ore and minerals, upon which each of said plurality of wear elements is mounted spaced apart from others of said plurality of wear elements, in order to protect, as a portion of the lining, the drum against wear during its rotation, each of said plurality of wear elements consisting of a foot portion (16) for fixing said wear element in the drum and an upper portion (17) joined to the foot portion (16) and arranged to extend into the drum, characterized in that the upper portion (17) has a carcass of wear-resistant metal, comprising an elongated forward wall element (20) facing the direction of rotation of the wear element, an elongated rear wall element (22), and between these wall elements, transverse wall elements (24), the wall elements of the carcass defining between them a plurality of spaces (26) which are at least partially filled with a filler (28) of another material than any of the components of the mill charge, and of greater abrasive specific volume loss than the metal of the carcass (18).

* * * * *